US005265307A

United States Patent [19]

Hull et al.

[11] Patent Number: 5,265,307

[45] Date of Patent: Nov. 30, 1993

[54] ERGONOMIC, ADJUSTABLE HANDLE

[76] Inventors: Harold L. Hull, 401 Canyon Way #43, Sparks, Nev. 89434; Judith Aston, P.O. Box 3568, Incline Village, Nev. 89450

[21] Appl. No.: 937,135

[22] Filed: Aug. 31, 1992

[51] Int. Cl.[5] ..... A47B 95/02; A47J 45/06

[52] U.S. Cl. ..... 16/114 R; 16/125

[58] Field of Search ..... 16/114 R, 125, 111 R

[56] References Cited

U.S. PATENT DOCUMENTS

| | | | |
|---|---|---|---|
| 2,617,142 | 7/1949 | Cadwell et al. | 16/114 R |
| 4,112,542 | 9/1978 | Snyder | 16/114 R |
| 4,701,142 | 10/1987 | Merritt | 16/114 R |
| 4,890,355 | 1/1990 | Schulten | 16/111 R |
| 5,031,319 | 7/1991 | Althaus et al. | 30/85 |
| 5,046,387 | 9/1991 | Levake | 81/489 |
| 5,046,739 | 9/1991 | Reichow | 273/148 B |

*Primary Examiner*—John Sipos
*Assistant Examiner*—Carmine Cuda

[57] ABSTRACT

Disclosed is an ergonomic handle which may be attached to any suitable object such as a briefcase, luggage, instrument cases, etc., which may then be adjustable through its vertical and horizontal axis and moved forward or backward on its mounting base to locate the most optimum balance point and the best ergonomic relationship between the fingers, wrist, elbow and shoulder of the user.

6 Claims, 2 Drawing Sheets

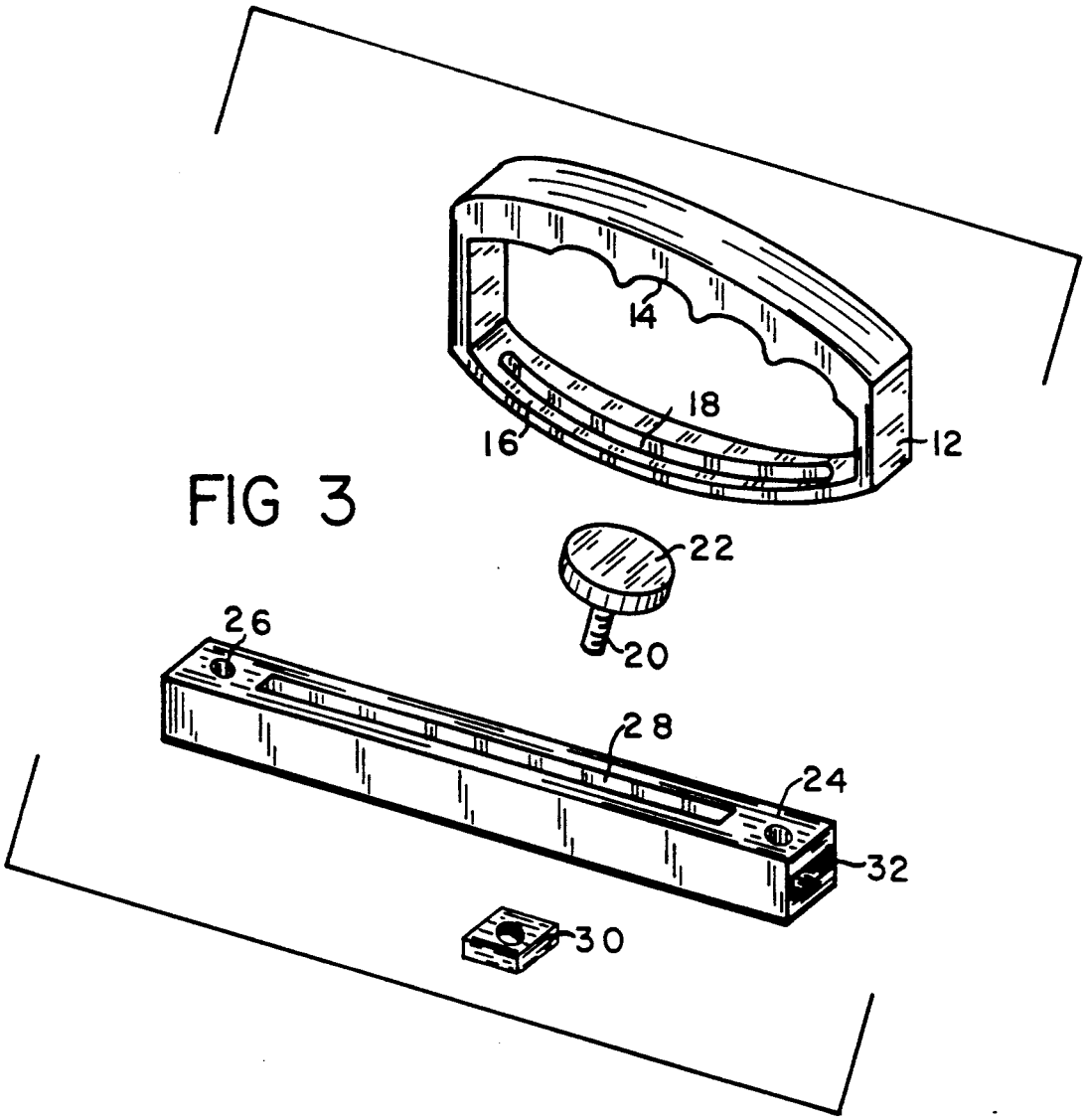
FIG 3
FIG 4
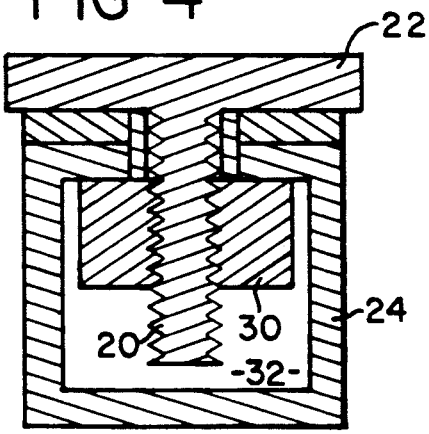

ERGONOMIC, ADJUSTABLE HANDLE

FIELD OF THE INVENTION

This invention relates to handles but more particularly to a handle for carrying objects such as briefcases or luggage etc., and is specifically designed to be adjustable, ergonomically pleasing and hand friendly.

BACKGROUND OF THE INVENTION

In the past, many types of handles have been disclosed which are designed for a specific purpose, such as U.S. Pat. No. 5,046,739 which teaches an ergonomic handle for a game controller, or U.S. Pat. No. 5,046,387 which discloses a multi-functional tool handle, also U.S. Pat. No. 5,031,319 which provides a wet razor having an ergonomic handle. U.S. Pat. No. 4,890,355, No. 3,800,361 and No. 3,083,366 all provide a handle device which is specifically designed to cooperate with cord or wire loop handles attached to shopping bags or the like.

Each of these references have ergonomic value and are complete and functional for their intended purpose, however none of these Patents have disclosed the unique qualities inherent within the present invention.

In todays world there is a growing concern and interest in alleviating or reducing the high incidence of limited range of motion disorders, such as Carpal Tunnel Syndrome, golf or tennis elbow, or the like In many cases, these disorders are caused or irritated by the use of poorly designed hand tools, devices, handles etc.

The present invention addresses this problem in a unique and unusual manner. The handle as taught in the present invention allows for proper alignment of the points of the hand, wrist, elbow and shoulder. Also, because the hand grip assumes the hand shape by design, reduces muscle fatigue, as no additional muscular effort, such as twisting or turning, is required to hold the handle. The handle also includes adjustment means, whereby, the user can position the handle to any angle which the individual feels is most comfortable and convenient, and in most cases this position utilizes the muscles natural tendency to position the arm, wrist and hand in a slightly rotated outward position with the little finger slightly away from the body. Therefore, this natural positioning of the handle cooperates with the muscles own structure, but yet still allows the object being carried, such as a suitcase, to remain parallel to the body for ease of movement while walking.

SUMMARY OF THE INVENTION

It is therefore a primary object of the present invention to provide a handle which is ergonomically pleasing and hand friendly.

Another object is to provide a handle which is adjustable on its vertical and horizontal axis.

Still another object is to provide a handle which may be moved forward or backward in relation to its mounting base to change the weight distribution.

It is still another object to provide a handle which is ergonomic and hand friendly to be attached to an object to be pushed as well as pulled.

Yet another object is to provide the handle with a removable mounting, so as to allow the user to conveniently secure the handle to any object which they wish to use.

Another important object is to provide a handle which eliminates unnecessary stress, fatigue, muscle strain, etc.

Other objects and advantages will become apparent when taken into consideration with the following specifications and drawings.

BRIEF DESCRIPTION OF THE DRAWINGS

FIG. 3 is a blown-up, perspective view, which shows assembly of the handle.

FIG. 4 is an enlarged, sectional view taken at 4—4 of FIG. 1.

DETAILED DESCRIPTION OF THE DRAWINGS

Figure 1:
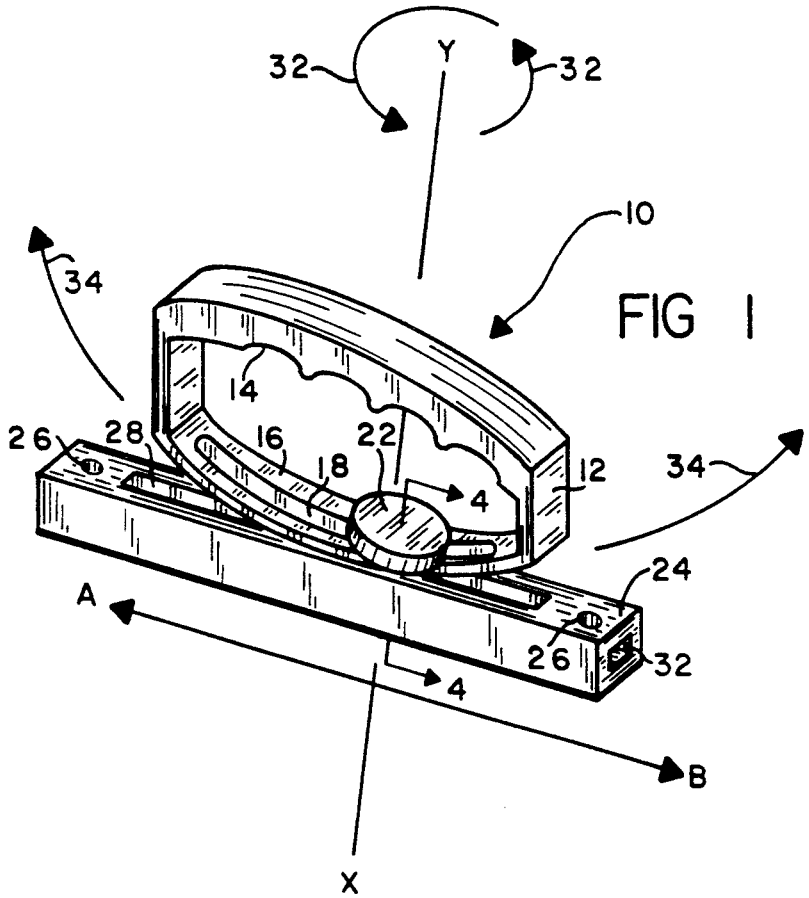
FIG. 1 is a perspective view of a handle which shows its rotational and vertical movement.
Figure 2:
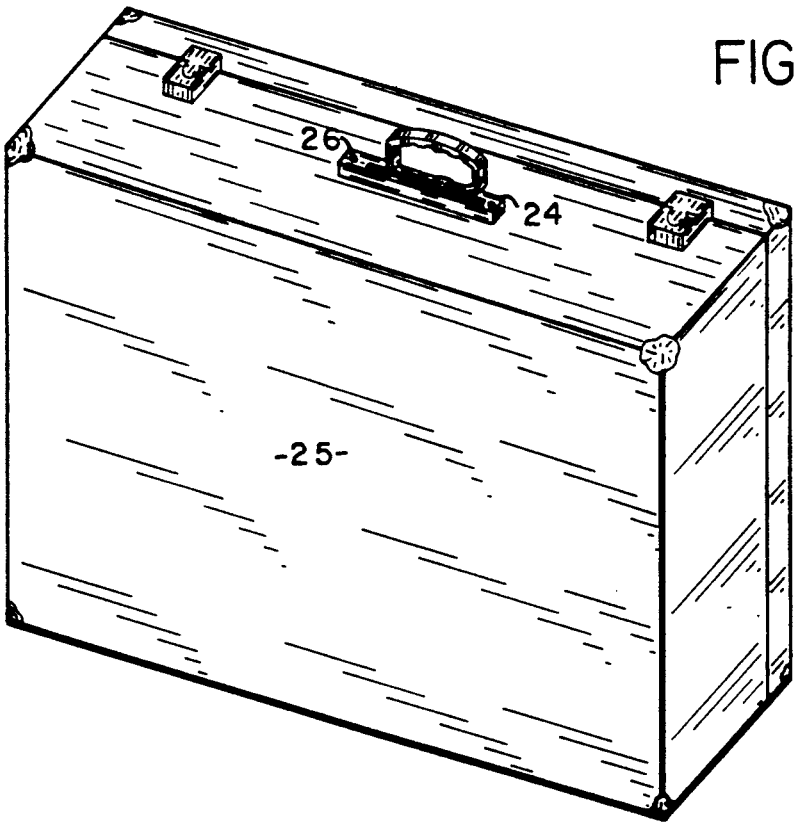
FIG. 2 is a perspective view of the invention while mounted on a typical suitcase.

Referring now in detail to the drawings wherein like characters refer to like elements throughout the various drawings, 10 is an overview of the handle with 12 being substantially a rectangular member having a top gripping surface 14 and a bottom portion 16, 16 being substantially in the form of a circular section lengthwise, and having an elongated slot 18 to accept the threaded shank portion 20 of thumb screw 22. 24 is substantially, a square, tubular, elongated base with mounting holes 26, base 24 also having an elongated slot 28 to accept the threaded shank portion 20 of thumb screw 22, which is adjustably anchored within the tubular base 24 by square nut 30 which slides into the interior 32 of base 24. FIG. 2 shows the handle 10 being mounted on a typical suitcase or briefcase 25.

It will now be seen that the handle 10 is adjustable by loosening the thumb screw 22 which allows the handle to move forward or backward in relation to its base, in its linear plane A-B to balance the load more equally and may be turned or twisted on its X-Y axis and also moved to multiple positions on its partial semi-circle portion 16, as depicted by arrows 34. Thus providing a handle that may be positioned in the most advantageous, ergonomic position to create the least amount of strain on the hand, wrist, elbow and shoulder, in the event of the briefcase being carried or pushed, such as might be the case if the briefcase had casters, (not shown).

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

Having described our invention, what we claim as new and desire to secure by letters patent is:

1. An ergonomic handle adapted to be attached to an object to be gripped by at least one hand of a person comprising; a mounting member, means to attach said mounting member to an object, said handle having a gripping portion adapted to be grasped by a human hand, said mounting member being a substantially square hollow tube, said tube having at least one elongated slot, a thumb screw and nut, said handle having a mounting portion adapted to be mounted to said mounting member, whereby, when said mounting member is attached to said object and said mounting portion of said handle is attached to said mounting member by said thumb screw and nut thru said elongated slot, said handle may be retainably adjustable to said mounting member to provide an optimum ergonomic relationship with said human hand in at least one of its axis.

2. The handle of claim 1 in which said handle may be retainably adjustable to said mounting member to provide an optimum ergonomic relationship with said human hand in at least two of its axis.

3. The ergonomic handle of claim 1 in which said handle may be retainably adjusted to said mounting member in multiple forward or backward positions to provide a variable weight shift relationship between said handle and said object to be carried.

4. The ergonomic handle of claim 1 in which said mounting portion adapted to be mounted to said mounting member is substantially in the form of a circular section lengthwise, said mounting portion having at least one elongated slot, said slot cooperating with said thumb screw and nut to provide multiple retaining positions.

5. The ergonomic handle of claim 1 in which said object to be gripped by at least one hand of a person is a briefcase.

6. A method of providing an adjustable relationship between the human hand and an object to be gripped, comprising the steps of;

a. attaching a mounting member in the form of a substantially square hollow tube, said hollow tube having at least one elongated slot, to said object to be gripped;

b. said mounting member supporting an adjustable handle having a mounting portion in substantially the form of a circular section having at least one elongated slot, c. loosening a thumb screw and nut between said mounting member and said handle;

d. adjusting the handle to an optimum position on its vertical and horizontal axis in relation to said object to be gripped to provide the least amount of strain on the fingers, wrist, elbow, and shoulder of the carrier;

e. adjusting the handle forward or backward in its relationship to said mounting member to adjust the weight of said object to be gripped to its most balanced position and f. tightening the thumb screw and nut between said mounting member and said mounting portion of said handle.

* * * * *